US005265633A

United States Patent [19]

Knowlton

[11] Patent Number: 5,265,633

[45] Date of Patent: Nov. 30, 1993

[54] PARTS WASHER

[76] Inventor: Glenn C. Knowlton, 2262 Bronson Dr., St. Paul, Minn. 55112

[21] Appl. No.: 672,849

[22] Filed: Mar. 21, 1991

[51] Int. Cl.[5] ..... B08B 13/00

[52] U.S. Cl. ..... 134/135; 134/200; 134/201; 4/619; 312/228

[58] Field of Search ..... 134/111, 201, 200, 135, 134/172; 68/3 R; 220/572, 4.26, 23.86; 4/619, 630, 638, 647, 648, 649; 312/228; 411/34, 55; 206/577

[56] References Cited

U.S. PATENT DOCUMENTS

| | | | |
|---|---|---|---|
| 2,156,541 | 5/1939 | Misenhimer et al. | 68/3 R |
| 2,300,231 | 10/1942 | Landgraf | 68/3 R |
| 2,446,693 | 8/1948 | Davis | 134/115 |
| 2,456,480 | 12/1948 | Austin | 411/34 X |
| 2,471,506 | 5/1949 | Wiswall | 134/104.4 X |
| 2,542,967 | 2/1951 | Waechter | 411/34 X |
| 2,688,894 | 9/1954 | Modrey | 411/34 |
| 2,805,017 | 9/1957 | Hill et al. | 248/346 X |
| 2,994,761 | 8/1961 | Hart et al. | 4/638 X |
| 3,021,927 | 2/1962 | McKee, Jr. | 411/34 X |
| 3,522,814 | 8/1970 | Olson | 134/111 |
| 4,056,114 | 11/1977 | Boutillette | 134/111 X |
| 4,462,415 | 7/1984 | Otzen | 134/111 |
| 4,464,256 | 8/1984 | Plourde | 134/111 |
| 4,827,955 | 5/1989 | Stearn | 134/111 X |
| 5,107,876 | 4/1992 | Ozyjiwsky | 134/111 |

FOREIGN PATENT DOCUMENTS

| | | | |
|---|---|---|---|
| 1293424 | 12/1961 | Fed. Rep. of Germany | 134/111 |
| 2449056 | 4/1976 | Fed. Rep. of Germany | 134/111 |
| 393240 | 10/1965 | Switzerland | 62/3 R |
| 588774 | 6/1947 | United Kingdom | 134/115 |

*Primary Examiner*—Frankie L. Stinson

*Attorney, Agent, or Firm*—Peterson, Wicks, Nemer & Kamrath

[57] ABSTRACT

A parts washer (10) is disclosed in its preferred form including modular components of a base (12), a reservoir (14), a reservoir cover (16), a wash basin (18), and a basin cover (20). The reservoir (14) is slideably received in a receptacle (34) formed in the base (12). The cover (16) is slideably received on the reservoir (14) with a positioning trough (70) of the cover (16) received in a groove (48) in the reservoir (14) and is removably fastened to the reservoir (14) by an expandable plug (114) insertable into and expandable within parallel assembly apertures (50, 68) formed in the reservoir (14) and the cover (16). The wash basin (18) abuts with the cover (16) and includes a depressed center portion having a drain depression formed therein which is slideably received and nestled within a depressed center portion having a drain depression formed in the cover (16) and further includes a positioning trough (88) which is slideably received and nestled within the trough (70) of the cover (16). An expandable plug (114) is insertable into and expandable within parallel assembly apertures (66, 90) formed in the basin (18) and the cover (16) for removably fastening the basin (18) to the cover (16). The basin cover (20) is hingedly mounted to the basin (18). Thus, the parts washer (10) can be quickly and easily assembled or disassembled. Further, the bends forming the various positioning elements of the components provide the necessary structural strength to allow vacuum forming the components from noncorrosive plastic material able to handle alkaline detergents and like biodegradable washing solutions.

19 Claims, 3 Drawing Sheets

PARTS WASHER

BACKGROUND

The present invention relates generally to parts washers, particularly to parts washers of noncorrosive material to handle alkaline detergents and like biodegradable solvents or washing solutions, and specifically to parts washers of a modular construction allowing quick assembly and disassembly.

During the manufacture and maintenance of mechanisms, it is necessary to remove oil, grease, dirt, carbon, varnish, baked on grime, and like elements from the components before assembly or reassembly of the mechanisms. This is often performed in a parts wash system where a washing solution is circulated past the components desired to be degreased and cleaned. Solvents which have been used in the past include Stoddard and 111 Trichlorethelene which are flammable and considered to be hazardous to the environment in that fumes are released to the atmosphere which are harmful to persons in the vicinity and that the liquid contaminated with the elements cleaned from the components must be disposed of. Thus, an increasing need has been seen for biodegradable washing solutions to replace prior hazardous solvents.

While such a need exists, replacement of hazardous solvents by biodegradable washing solutions has been slow even though environmental agencies and groups have been pushing for such replacements. One problem is that many if not most biodegradable washing solutions do not perform as well as existing hazardous solvents, but rather are generally slow and short lived. Further, biodegradable washing solutions themselves pose new problems. Particularly, such biodegradable washing solutions are highly corrosive to existing parts washers themselves. Additionally, the performance of biodegradable washing solutions typically increases with elevated temperatures.

Thus, a need exists for parts washers formed of noncorrosive material to handle biodegradable washing solutions. Additionally, a need exists for parts washers allowing heating of nonflammable washing solutions to increase the chemical performance of such washing solutions. Further, a need exists for parts washers of a modular construction which can be quickly assembled and disassembled. Furthermore, a need exists for a parts washer which is economical to manufacture, service, and operate and particularly which is generally competitive with prior upright barrel parts washers to the point that biodegradable washing solution parts washers are economically competitive with hazardous solvent parts washers and without considering the environmental benefits of biodegradable washing solutions over hazardous solvents.

SUMMARY

The present invention solves these needs and other problems in the field of parts washers by providing, in a first preferred aspect of the present invention, first and second positioning elements integrally formed with the wash basin and the cover of the reservoir and free of any separable components for maintaining a unique positional relationship between the wash basin and the cover in a horizontal plane when the positional elements are in positional agreement and members for selectively preventing vertical movement of the wash basin relative to the cover from the unique positional relationship.

In a further aspect of the present invention, a fastener is provided including a member which is removably insertable through first and second assembly apertures formed in first and second members with access required from only one side and which is removably engageable with the members inside of the first and second assembly apertures.

In still a further aspect of the present invention, such fasteners are utilized for removably fastening the wash basin to the reservoir cover and the reservoir cover to the reservoir of a parts washer.

It is thus an object of the present invention to provide a novel parts washer.

It is further an object of the present invention to provide a novel fastener, a preferred use of which is in a parts washer.

It is further an object of the present invention to provide such a novel parts washer formed of noncorrosive material to handle alkaline detergents and like biodegradable washing solutions.

It is further an object of the present invention to provide such a novel parts washer of a modular construction.

It is further an object of the present invention to provide such a novel parts washer which is vacuum formed.

It is further an object of the present invention to provide such a novel parts washer which can be quickly assembled and disassembled.

It is further an object of the present invention to provide such a novel parts washer including positioning elements which rapidly position and maintain the components in unique positional relationships.

It is further an object of the present invention to provide such a novel parts washer which is economical to manufacture, service, and operate.

It is further an object of the present invention to provide such a novel parts washer which thermally isolates the washing solution to allow ease of heating of the washing solution.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
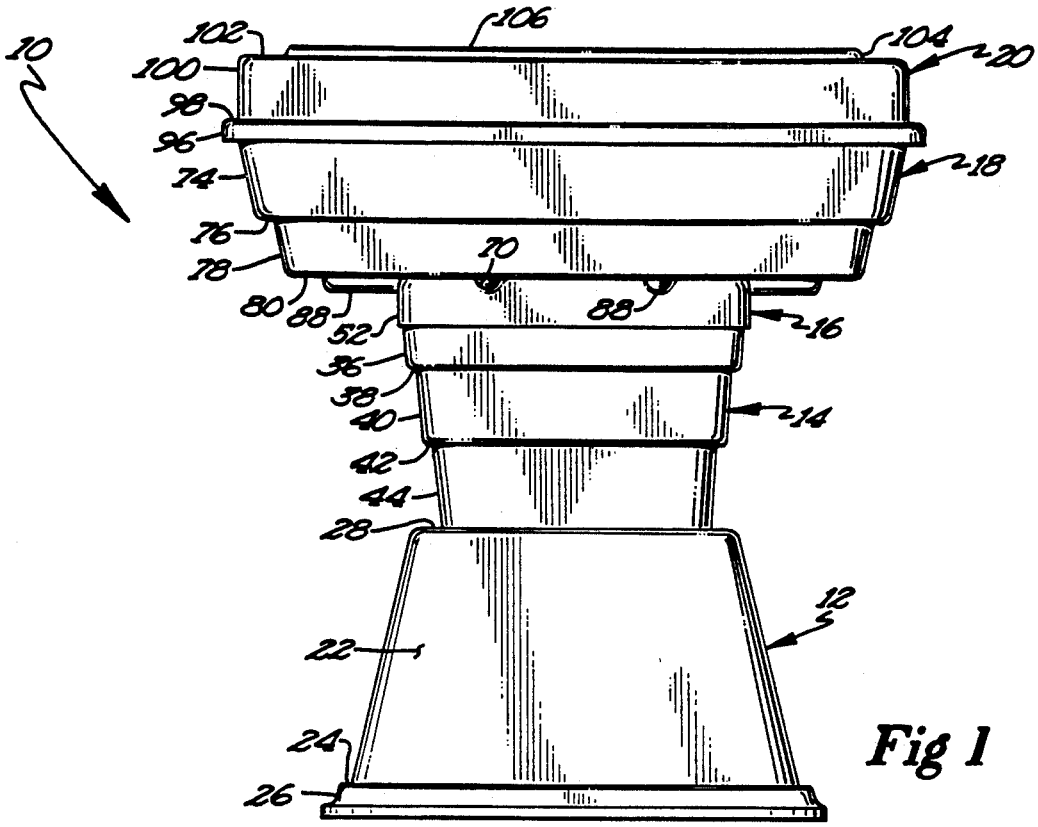
FIG. 1 shows a front elevational view of a parts washer according to the preferred teachings of the present invention.
Figure 3:
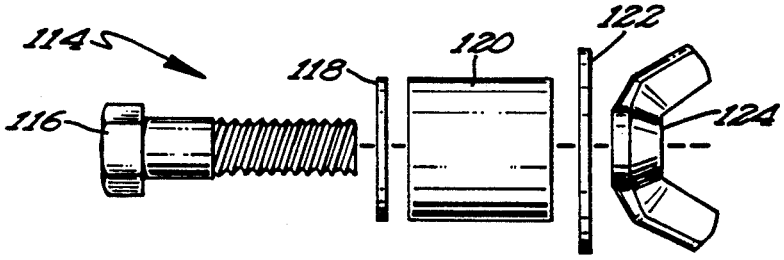
FIG. 3 is an exploded, front elevational view of an expandable plug utilized in the parts washer of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "inside", "outside", "front", "rear", "side", "lend", "horizontal", "vertical", "inner", "outer", "upper", "lower", and similar terms are used herein, it should be understood that these terms have reference only to the structure shown in the drawings as it would appear to a person viewing the drawings and are utilized only to facilitate describing the invention.

DESCRIPTION

A parts washer according to the preferred teachings of the present invention is shown in the drawings and generally designated 10. Washer 10 is formed of a modular construction including a base 12, a reservoir 14, a reservoir cover 16, a wash basin 18, and a basin cover 20. In the preferred form, the modular components of washer 10 are formed of noncorrosive material to handle water based alkaline detergents and like biodegradable washing solutions and in the most preferred form are formed of vacuum formed, high molecular polyethylene.

Base 12 is generally of the shape of a frustum of a square pyramid and generally includes four sides 22 of an issoceles trapezoid shape. The lower edges of each side 22 terminate in and are integrally formed with a generally horizontal flange 24 extending outwardly therefrom and in turn terminating in and integrally formed with a generally vertical flange 26 for abutting with the support surface such as the shop floor. The upper edges of each side 22 terminate in and are integrally formed with generally horizontal flange 28 extending inwardly therefrom and in turn terminating in and integrally formed with a generally vertical sidewall 30. The opposite ends of the four sidewalls 30 terminate in and are integrally formed with a generally horizontal support surface 32. It can be appreciated that the end edges of sides 22, flanges 24, 26, and 28 and sidewalls 30 are integrally connected together. It can be appreciated that sidewalls 30 and support surface 32 define a receptacle 34 of a size complementary to and for slideably receiving reservoir 14.

Reservoir 14 is generally of the shape of an inverted frustum of a square pyramid but having a base of a smaller size than that of base 12. In the preferred form, reservoir 14 includes four generally vertical sides 36 terminating in and integrally formed with generally horizontal ribs 38 extending inwardly therefrom. In turn, the opposite, inner edges of ribs 38 terminate in and are integrally formed with generally vertical sides 40 extending downwardly therefrom. In turn, the opposite, lower edges of sides 40 terminate in and are integrally formed with ribs 42 extending inwardly therefrom. In turn, the opposite, inner edges of ribs 42 terminate in and are integrally formed with generally vertical sides 44 extending downwardly therefrom. In turn, the opposite, lower edges of sides 44 terminate in and are integrally formed with a generally horizontal bottom 46. It can be appreciated that the end edges of sides 36, 40, and 44 and of ribs 38 and 42 are integrally connected together. The upper edges of sides 36 and in the most preferred form the three sides 36 forming the front and ends of parts washer 10 include routed grooves or detents 48 having a semicircular shape. Sides 36 and in the most preferred form the three sides 36 forming the front and ends of parts washer 10 further include assembly apertures 50. In the most preferred form, sides 44 have a height generally equal to twice the height of either side 36 or side 40 and twice the height of sidewalls 30 of receptacle 34.

Cover 16 generally includes an annular, generally vertical, perimeter portion 52 of a size and shape complementary to and for slideable receipt of sides 36 of reservoir 14. The upper edges of perimeter portion 52 terminate in and are integrally formed with an annular, generally horizontal perimeter portion 54 extending inwardly therefrom. The opposite, inside edges of horizontal perimeter portion 54 terminate in and are integrally formed with an inverted frustum 56 of a square pyramid extending downwardly and inwardly therefrom. The opposite, lower edges of frustum 56 terminate in and are integrally formed with a horizontal wall 58. Wall 58 includes a downwardly extending, generally cylindrical depression having a cylindrical sidewall 60 terminating in a generally horizontal, circular end wall 62. A drain aperture 64 is formed in end wall 62 concentric with sidewall 60. Wall 58 includes assembly apertures 66 spaced from sidewall 60 and frustum 56. Perimeter portion 52 and in the most preferred form the front and ends of perimeter portion 52 also include assembly apertures 68 of a size, shape, and location complementary to assembly apertures 50 of reservoir 14. Troughs 70 are formed in perimeter portion 54 intersecting and integral with perimeter portion 52 and frustum 56. The cross section (semicircular in the preferred form) and location of troughs 70 correspond and are complementary to grooves 48 of reservoir 14. Wash basin 18 generally includes a rectangular, annular, generally vertical perimeter portion 72. The inner edges of perimeter portion 72 terminate in and are integrally formed with an inverted frustum 74 of a rectangular pyramid extending downwardly and inwardly therefrom. The opposite, lower edges of frustum 74 terminate in and are integrally formed with a rectangular, generally horizontal, annular rib 76 extending inwardly therefrom. The opposite, inner ends of rib 76 terminate in and are integrally formed with an inverted frustum 78 of a rectangular pyramid extending downwardly and inwardly therefrom. The lower ends of frustum 78 terminate in and are integrally formed with a bottom 80. Bottom 80 includes a depressed center portion having a sidewall 82 of the shape of an inverted frustum of a square pyramid and of a size complementary to and for slideable receipt within frustum 56 of cover 16 and terminating in a generally horizontal, square, end wall 84 of a size complementary to and for abutment with horizontal wall 58 of cover 16. Wall 84 includes a downwardly extending, generally cylindrical depression corresponding to and for slideable receipt in the cylindrical depression of cover 16 and specifically includes a cylindrical sidewall terminating in a generally horizontal, circular end wall, with the circular end wall having a drain aperture 86 of a size, shape, and location corresponding and complementary to drain aperture 64 of cover 16. Troughs 88 are formed in bottom 80 intersecting and integral with side wall 82 of the depressed center portion. The cross section (semicircular in the preferred form) and location of troughs 88 correspond and are complementary to troughs 70 of cover 16. End wall 84 further includes assembly apertures 90 of a size, shape, and location complementary to assembly apertures 66 of cover 16. Hinge portions 92 are integrally formed with the rear of perimeter portion 72 and frustum 74. In the most preferred form, the rear sidewall of the depressed center portion extends above bottom 80 and terminates in and is integrally formed with a generally horizontal extension 94 extending inwardly from and integral with rib 76.

Cover 20 generally includes a rectangular, annular, generally vertical perimeter portion 96 of a size and shape complementary to and for slideable receipt on the outside edges of perimeter portion 72 of basin 18. The upper edges of perimeter portion 96 terminate in and are integrally formed with a rectangular, annular, generally horizontal perimeter portion 98 extending inwardly therefrom. The opposite, inside edges of perimeter portion 98 terminate in and are integrally formed with a frustum 100 of a rectangular pyramid extending upwardly and inwardly therefrom. The opposite, upper edges of frustum 100 terminate in and are integrally formed with a rectangular, annular, generally horizontal wall 102 extending inwardly therefrom. The opposite, inner edges of wall 102 terminate in and are integrally formed with a rectangular, annular, generally vertical rib 104 extending upwardly therefrom. The opposite upper edges of rib 104 terminate in and are integrally formed with a rectangular, generally horizontal top 106. In the most preferred form, hinge portions 108 are integrally formed with the rear of perimeter portions 96 and 98. Hinge pins 110 extend through hinge portions 92 and 108 to hingedly mount cover 20 to basin 18. A suitable lamp 112 may be secured to cover 20 to illuminate wash basin 18 with cover 20 in its open position.

Figure 4:
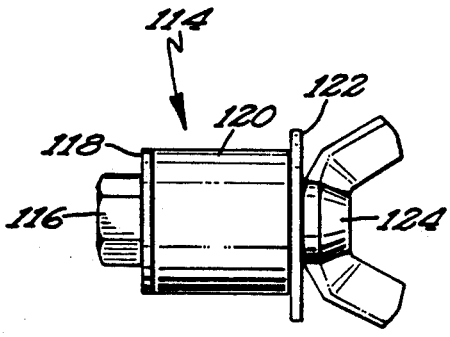
FIGS. 4 and 5 are front elevational views of the expandable plug of FIG. 3 in its loosened and sandwiched conditions, respectively.
Figure 5:
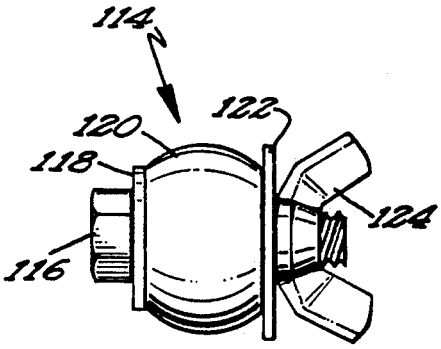
Figure 2:
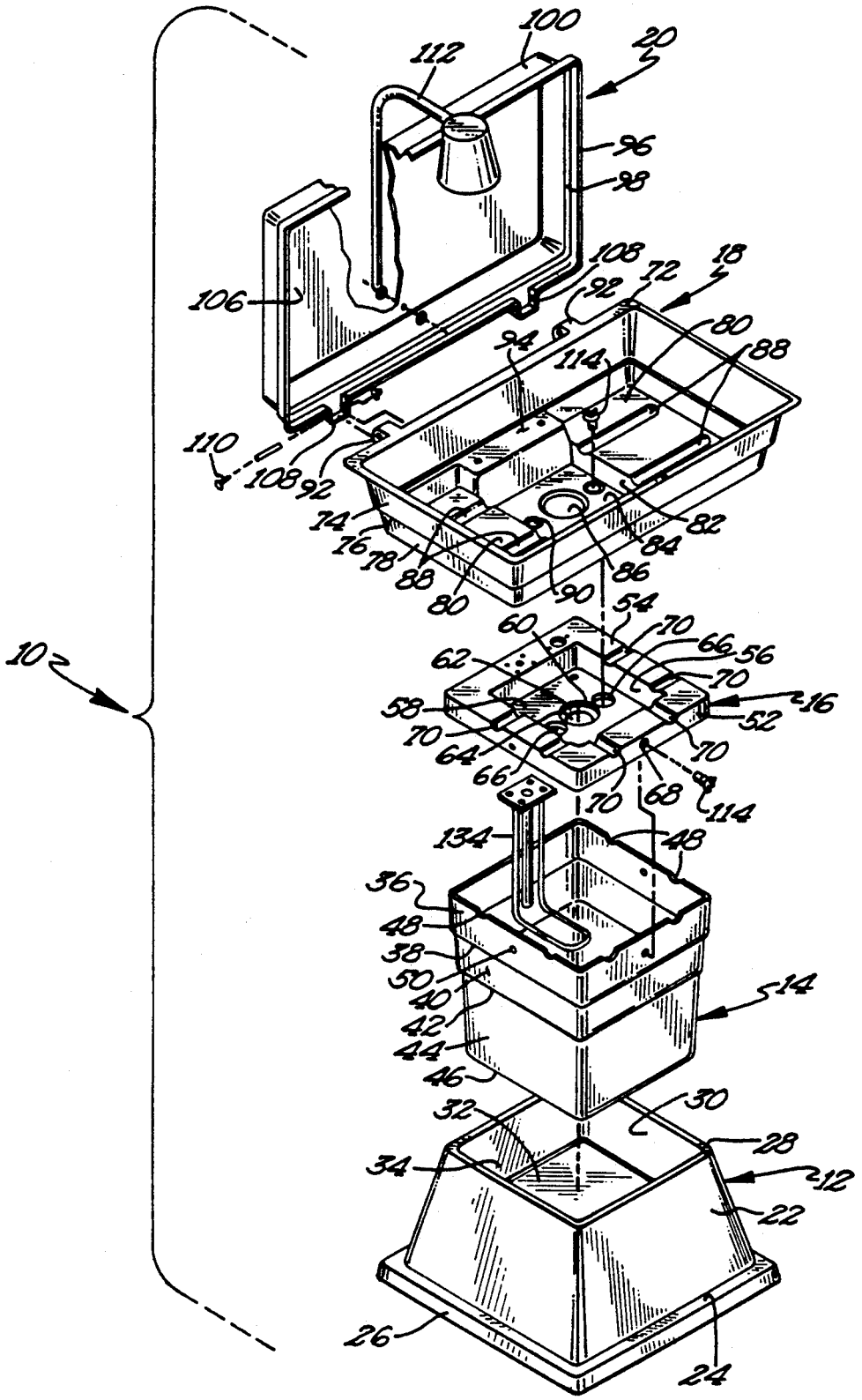
FIG. 2 is an exploded perspective view of the parts washer of FIG. 1.
Figure 6:
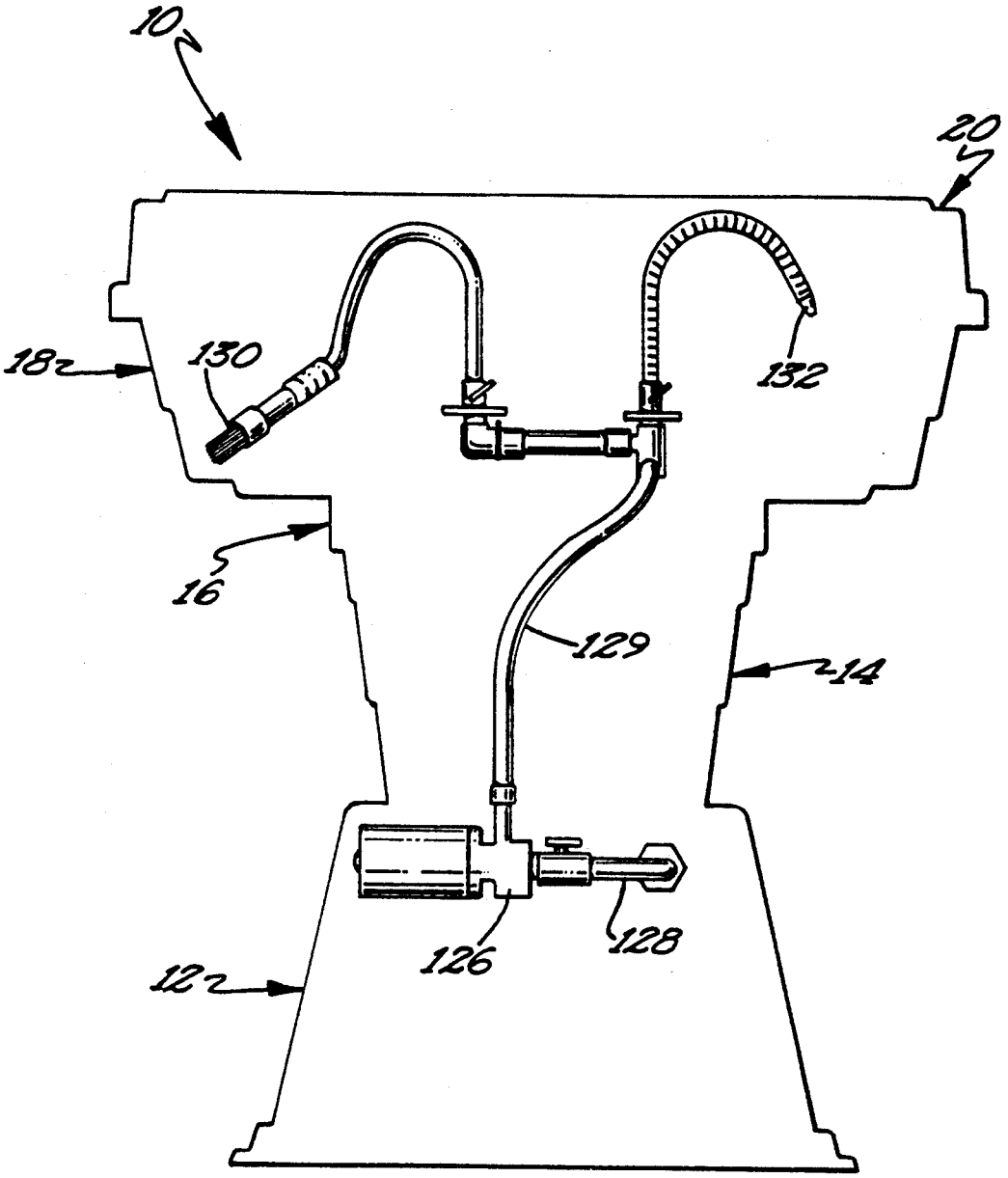
FIG. 6 is a diagrammatic view of the solution circulating provisions of the parts washer of FIG. 1.

Parts washer 10 further includes an expandable plug 114 according to the preferred teachings of the present invention for removably fastening basin 18 to cover 16 and cover 16 to reservoir 14. Specifically, plug 114 is generally of the type utilized to plug radiator connections during repair and generally includes a bolt 116 slideably received within a first washer 118, a length of flexible tubing 120, and a second washer 122. Washer 118 and tubing 120 have diameters generally equal to but slightly smaller than assembly apertures 50, 66, 68, and 90 for slideable receipt therein whereas washer 122 has a diameter larger than assembly apertures 50, 66, 68, and 90. A wing nut 124 is threadably received on bolt 116, with washers 118 and 122 sandwiching tubing 120 and with the head of bolt 116 and wing nut 124 sandwiching washers 118 and 122 with tubing 120 therebetween. It can then be appreciated that in a loosened condition as shown in FIG. 4, tubing 120 is in a natural or normal condition having a constant diameter. However, if wing nut 124 is tightened on bolt 118 to axially compress tubing 120, plug 114 is in an expanded condition with tubing 120 sandwiched between washers 118 and 122 and bulging therebetween such that an increased or expanded diameter results as shown in FIG. 5.

To assemble parts washer 10 according to the teachings of the present invention, reservoir 14 can be vertically slid into receptacle 34 of base 12 and to nest therein in a unique positional relationship. Specifically, it can be appreciated that the height of sidewalls 30 of receptacle 34 is sufficient and the relative cross sectional sizes of sides 44 of reservoir 14 and sidewalls 30 of receptacle 34 are such to receive reservoir 14 in receptacle 34 in a manner to prevent tipping of reservoir 14 relative to base 12. Cover 16 can then be slid upon reservoir 14 to nest thereon. It can be appreciated that cover 16 is interlocked on reservoir 14 in a unique positional relationship in a horizontal plane due to the complementary sliding relationship of perimeter portion 52 of cover 16 on sides 36 of reservoir 14 and the slideable receipt of troughs 70 of cover 16 in grooves 48 of reservoir 14. In the unique positional relationship of the nested cover 16 and reservoir 14, assembly apertures 50 and 68 are located in parallel, vertical planes. Cover 16 is fastened to reservoir 14 in their interlocked position to selectively prevent vertical movement therebetween by inserting plugs 114 in their loosened condition as shown in FIG. 4 into assembly apertures 50 and 68 of reservoir 14 and cover 16, with washer 122 abutting with perimeter portion 52 for preventing plugs 114 from being pushed through apertures 50 and 68. Wing nuts 124 can then be tightened on bolts 116 to compress tubing 120 between washers 118 and 122 as shown in FIG. 5 and expanding the diameter of tubing 120 to that of apertures 50 and 68 and thus engaging reservoir 14 and cover 16 inside of apertures 50 and 68. It can then be appreciated that plugs 114 are horizontally insertable into apertures 50 and 68 from outside cover 16 and without access required from the interior of reservoir 14 and cover 16 and prevent slideable movement of cover 16 relative to reservoir 14 in their interlocked, nested condition. Furthermore, it can be appreciated that tubing 120 seals apertures 50 and 68 for preventing passage of fluids therethrough. Wash basin 18 can then be positioned in a nested, interlocked position abutting with cover 16, with the cylindrical depression of basin 18 received in the cylindrical depression of cover 16, with the depressed center portion of basin 18 received in the depressed center portion of cover 16 formed by frustum 56 and wall 58, and with troughs 88 of basin 18 received in troughs 70 of cover 16 to maintain a unique positional relationship between basin 18 and cover 16 in a horizontal plane. In the unique positional relationship of the nested basin 18 and cover 16, assembly apertures 66 and 90 are located in parallel, horizontal planes. Wash basin 18 is fastened to cover 16 in their interlocked position by selectively preventing vertical movement of basin 18 relative to cover 16 by inserting plugs 114 in their loosened condition as shown in FIG. 4 into assembly apertures 66 and 90 of cover 16 and wash basin 18, with washer 122 abutting with end wall 84 for preventing plugs 114 from being pushed through apertures 66 and 90. Wing nuts 124 can then be tightened on bolts 116 to compress tubing 120 between washers 118 and 122 as shown in FIG. 5 and expanding the diameter of tubing 120 to that of apertures 66 and 90 and thus engaging cover 16 and wash basin 18 inside of apertures 66 and 90. It can then be appreciated that plugs 114 are vertically insertable into apertures 66 and 90 through wash basin 18 and without access required from the interior of reservoir 14 and cover 16 and prevent slideable movement of wash basin 18 relative to cover 16 in their interlocked condition. To disassemble parts washer 10 according to the preferred teachings of the present invention such as for servicing parts washer 10 including emptying reservoir 14, the above procedure can be simply reversed.

Parts washer 10 further includes suitable provisions for circulating washing solution from reservoir 14 to wash basin 18. For example, such provisions would include a pump 126 in fluid communication through suitable connections 128 with the washing solution located within reservoir 14 for delivering solution through suitable connections 129 to dispensing faucets such as flow through brushes 130 and flexible goose neck tubes 132 which in the preferred form are mounted to and extend from horizontal extension 94 of basin 18. The solution would then drain from wash basin 18 through drain apertures 64 and 86 back into reservoir 14. It can be appreciated that a bag filter assembly can be received in the cylindrical depression of basin 18 and extend through apertures 64 and 86 into reservoir 14 to filter out foreign material to prevent continual recycling through pump 126. Furthermore, when a water based alkaline detergent or like cleaning solution is used, suitable provisions 134 can be provided to parts washer 10 to heat the cleaning solution for delivery to basin 18 such as a heating element suspended from cover 16 and extending into the cleaning solution located in reservoir 14. A suitable stopper can be provided for temporarily holding the cleaning solution in basin 18 to allow soaking of parts and/or to prevent solution evaporation through apertures 64 ana 86 when parts washer 10 is not in use.

It can then be appreciated that base 12 according to the teachings of the present invention is believed to be advantageous. Specifically, the tapered design of base 12 provides improved stability over prior upright barrel parts washers. Further, the tapered design of base 12 provides increased structural strength required to allow vacuum formation in the preferred form. It can further be appreciated that this structural strength is further enhanced by the bends required to form flanges 24, 26, and 28 and receptacle 34. Further, receptacle 34 provides an air space underneath the washing solution in reservoir 14 thus isolating the washing solution from the usual concrete shop floor to prevent the typically cold concrete from cooling the washing solution. Further, sides 22 define an enclosed air barrier extending beneath and around the lower sides of the washing solution in reservoir 14. This air barrier provides insulation to prevent heat transfer. Further, any heat loss would heat the air enclosed within the air barrier which would then reduce further heat transfer than would occur if ambient air was continually exposed to reservoir 14. Thus, parts washer 10 according to the teachings of the present invention allows the temperature of the washing solution to be efficiently and economically raised and maintained. Further, receptacle 34 provides extra support to sides 44 and bottom 46 of reservoir 14 to allow vacuum forming of reservoir 14 in the most preferred form.

It can also be appreciated that the bends forming ribs 38 ana 42 of reservoir 14 provide structural strength to further allow vacuum forming of reservoir 14 in the most preferred form. Likewise, the bends forming troughs 70, between portions 52 and 54, between portion 54 and frustum 56, between frustum 56 and wall 58, and forming the cylindrical depression provide structural strength to allow vacuum forming of cover 16 in the most preferred form. Further, troughs 70 interlock in grooves 48 allowing quick assembly and placement of cover 16 on reservoir 14. Further, the depressed center portion formed by frustum 56 and wall 58 of cover 16 insures that any solvent which might escape will flow through aperture 64 into reservoir 14.

It can further be appreciated that the bends forming troughs 88, the cylindrical depression, the depressed center portion, rib 76, and perimeter portion 72 provide structural strength to wash basin 18 to allow its vacuum formation in the most preferred form to provide maximum strength and flexibility to handle heavy parts. Further, troughs 88, the cylindrical depression, and the depressed center portion provide interlocking with cover 16 allowing quick assembly and placement of basin 18 on cover 16. Further, it can be appreciated that rib 76 provides a ledge surface upon which a shelf or the like can be supported.

It can also be appreciated that the bends forming portions 96 and 98, frustum 100, wall 102, rib 104 and top 106 provide structural strength to allow vacuum forming of cover 20 in the most preferred form.

It is then believed that the modular construction of parts washer 10 according to the preferred teachings of the present invention is believed to be particularly advantageous. Particularly, the positioning elements of parts washer 10, i.e. receptacle 34 of base 12 and sides 44 and bottom 46 of reservoir 14, sides 36 and grooves 48 of reservoir 14 and perimeter portions 52 and 54 and troughs 70 of cover 16, the depressed center portions, the cylindrical depressions, and troughs 70 and 88 of cover 16 and wash basin 18, and perimeter portion 72 of basin 18 and perimeter portions 96 and 98 of cover 20, are all integrally formed free of any separable components and allow easy and rapid positioning by a single person in the unique positional relationships without the use of tools. Specifically, it is only necessary for the components to be generally positioned on each other and then pushed generally horizontally, with the components moving under gravitational forces to their lowermost, nestled condition with the positioning elements being in positional agreement to maintain the unique positional relationship between the modular components. Further, in the preferred form, such positioning elements create the necessary structural strength allowing the components to be vacuum formed of plastic material.

Further, expansion plugs 114 are believed to be particularly advantageous according to the preferred teachings of the present invention. Specifically, reservoir 14 and cover 16 and cover 16 and basin 18 can be quickly fastened together or unfastened without the use of tools. Further, apertures 50, 66, 68, and 90 can be easily drilled with minimal tolerances as any misalignment can be compensated by the flexible nature of tubing 120 of expansion plug 114. Similarly, it is not necessary to attach latches or other fastening means to the components of parts washer 10 during manufacture. Further, plugs 114 provide an effective liquid seal. Furthermore, the components of plug 114 can be formed of noncorrosive material such as from plastic to handle water based alkaline detergents or like biodegradable washing solutions.

Now that the basic teachings of the present invention have been explained, many extensions and variations will be obvious to one having ordinary skill in the art. For example, although the particular shapes of the modular components of parts washer 10 shown in the preferred form are believed to have a particularly pleasing and aesthetic ornamental appearance, it can be appreciated that such components can be fabricated with other appearances while still providing the functional requirements including but not limited to structural strength and interlocking and nesting abilities.

Furthermore, although parts washer 10 according to the most preferred form of the present invention includes several unique features whose combination are believed to produce synergistic results, it can be appreciated that such features can be utilized separately and in other combinations with the same and different features according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Parts washer comprising, in combination: a wash basin; a reservoir for holding a washing solution, with the reservoir including a cover having a horizontal portion, with the wash basin having a horizontal bottom abutting with the cover; means for maintaining a unique positional relationship between the wash basin and the cover in a horizontal plane including a first positioning element integrally formed in the bottom of the wash basin free of any separable components and a second positioning element integrally formed in the horizontal portion of the cover free of any separable components, with the first positioning element being movable under gravitational forces to a nestled condition with the second positioning element in the unique positional relationship; and at least first means for selectively preventing vertical movement of the wash basin relative to the cover while allowing separation of the wash basin from the cover by vertically moving the wash basin from the unique positional relationship.

2. The parts washer of claim 1 further comprising, in combination: a second means for selectively preventing vertical movement of the wash basin relative to the cover while allowing separation of the wash basin from the cover by vertically moving the wash basin from the unique positional relationship, with the first vertical movement selectively preventing means being horizontally spaced from the second vertical movement selectively preventing means; and wherein the vertical movement selectively preventing means comprises, in combination: a first assembly aperture formed in the wash basin; a second assembly aperture formed in the cover; and means removably insertable in the first and second assembly apertures for preventing vertical movement of the wash basin relative to the cover.

3. The parts washer of claim 2 wherein the first and second assembly apertures are located in parallel, horizontal planes; and wherein the removably insertable means is vertically insertable into the first and second assembly apertures from the wash basin without access from the side of the cover opposite the wash basin.

4. The parts washer of claim 3 wherein the removably insertable means comprises means for removably engaging the wash basin and the cover inside of the first and second assembly apertures.

5. The parts washer of claim 4 wherein the removably engaging means comprises an expandable plug having a first condition with a diameter insertable into the first and second assembly apertures and an expanded condition with a diameter generally equal to and for engaging the first and second assembly apertures.

6. The parts washer of claim 5 wherein the expandable plug comprises, in combination: a flexible tube; and means for axially compressing the flexible tube.

7. The parts washer of claim 1 wherein the first positioning element comprises a depressed center portion formed in the horizontal bottom of the wash basin; wherein the second positioning element comprises a depressed center portion formed in the horizontal portion of the cover, with the depressed center portion of the wash basin being complementary to and for nesting within the depressed center portion of the cover, with the depressed center portion of the wash basin and of the cover having horizontal cross sections which are non-circular in shape.

8. The parts washer of claim 7 further including drain apertures formed in the depressed center portion of the wash basin and of the cover allowing the washing solution to drain from the wash basin to the reservoir therethrough, with the drain apertures being spaced from the vertical movement selectively preventing means.

9. The parts washer of claim 8 wherein the first positioning element further comprises a depression formed in the depressed center portion of the wash basin; wherein the second positioning element further comprises a depression formed in the depressed center portion of the cover, with the depression of the wash basin being complementary to and for nesting with the depression of the cover, with the drain apertures formed in the depression of the wash basin and the cover.

10. The parts washer of claim 7 wherein the first positioning element comprises a trough having a generally semicircular cross section formed in the horizontal bottom of the wash basin; wherein the second positioning element comprises a trough having a generally semicircular cross section formed in the horizontal portion of the cover, with the trough of the wash basin being complementary to and for nesting with the trough of the cover.

11. The parts washer of claim 10 wherein the reservoir includes a side having a free edge, with the cover abutting with the free edge of the side; with the free edge including a semicircular groove, with the trough of the cover being complementary to and for nesting within the semicircular groove of the reservoir.

12. The parts washer of claim 11 wherein the cover includes a vertical perimeter portion for vertical slideable receipt on the reservoir; and wherein the parts washer further comprises, in combination: an assembly aperture formed in the vertical perimeter portion of the cover; an assembly aperture formed in the reservoir; and means removably insertable in the assembly apertures of the reservoir and the cover without access from the interior of the reservoir for preventing vertical movement of the cover relative to the reservoir.

13. The parts washer of claim 12 wherein the vertical movement preventing means comprises an expandable plug having a first condition with a diameter insertable into the assembly apertures of the reservoir and the cover and an expanded condition with a diameter generally equal to and for engaging the assembly apertures of the reservoir and the cover.

14. The parts washer of claim 7 wherein the depressed center portion of the wash basin and of the cover have the shape of an inverted frustum of a square pyramid.

15. The parts washer of claim 1 further comprising, in combination: a base including closed sides defining an enclosed air barrier; and a receptacle formed in the base for slideably receiving the reservoir to isolate the reservoir and the washing solution therein from the support surface and with the enclosed air barrier extending beneath and around the lower sides of the washing solution in the reservoir.

16. The parts washer of claim 15 wherein the cross section of the base at the support surface is larger than the cross section of the reservoir to provide improved stability.

17. The parts washer of claim 16 wherein the base is generally in the shape of a frustum of a square pyramid.

18. The parts washer of claim 15 further comprising, in combination: means for circulating washing solution from the reservoir to the wash basin, with the circulating means comprising a pump mounted outside the base and on the closed side of the base and in fluid communication with the washing solution located within the reservoir.

19. The parts washer of claim 1 wherein the first positioning element comprises a trough having a generally semicircular cross section formed in the horizontal bottom of the wash basin; wherein the second positioning element comprises a trough having a generally semicircular cross section formed in the horizontal portion of the cover, with the trough of the wash basin being complementary to and for nesting with the trough of the cover.

* * * * *